US012011636B2

(12) United States Patent
De Leon et al.

(10) Patent No.: US 12,011,636 B2
(45) Date of Patent: Jun. 18, 2024

(54) PHYSICAL THERAPY DEVICE

(71) Applicants: Reid Albert De Leon, League City, TX (US); Eric David Santiago, League City, TX (US)

(72) Inventors: Reid Albert De Leon, League City, TX (US); Eric David Santiago, League City, TX (US)

( * ) Notice: Subject to any disclaimer, the term of this patent is extended or adjusted under 35 U.S.C. 154(b) by 0 days.

(21) Appl. No.: 17/715,929

(22) Filed: Apr. 7, 2022

(65) Prior Publication Data

US 2023/0321477 A1 Oct. 12, 2023

(51) Int. Cl.
*A63B 21/16* (2006.01)
*A63B 21/00* (2006.01)

(52) U.S. Cl.
CPC ..... *A63B 21/169* (2015.10); *A63B 21/00047* (2013.01); *A63B 21/151* (2013.01)

(58) Field of Classification Search
CPC ..... A63B 21/00047; A63B 21/000178; A63B 21/00181; A63B 21/04; A63B 21/0442; A63B 21/169; A63B 21/4035; A63B 5/08; A63B 5/16; A63B 17/00; A63B 17/02; A63B 17/04; A63B 6/00; A63B 6/02; A63B 6/025
See application file for complete search history.

(56) References Cited

U.S. PATENT DOCUMENTS 5,839,991 A * 11/1998 Hall ..... A63B 23/00 482/910
6,066,105 A * 5/2000 Guillen ..... A63B 69/0053 600/595
9,737,748 B1 * 8/2017 Chapman ..... A63B 21/1681
9,821,184 B1 * 11/2017 Chapman ..... A61H 1/024
10,315,065 B1 * 6/2019 Soba ..... A63B 21/151
10,736,485 B1 * 8/2020 Galbraith ..... A47L 23/266
2009/0031658 A1 * 2/2009 Moller, Jr. ..... E01C 13/045 52/578
2012/0184409 A1 * 7/2012 Beal ..... A63B 69/0048 482/5
2015/0231469 A1 * 8/2015 Pretz ..... A63B 21/169 473/458
2015/0367158 A1 * 12/2015 Pretz ..... A63B 21/0557 482/129
2017/0136724 A1 * 5/2017 Dawson ..... D05C 17/02
2018/0104530 A1 * 4/2018 Dobronyi ..... A63B 21/4037
2020/0023257 A1 * 1/2020 Speed ..... A63B 69/0048
2020/0171369 A1 * 6/2020 Sudeith ..... A63B 69/0048
2021/0101061 A1 * 4/2021 Pell ..... A63B 69/0048
2022/0257990 A1 * 8/2022 Hetrick ..... A63B 21/0557
2022/0370871 A1 * 11/2022 Richert ..... A63B 71/0036

FOREIGN PATENT DOCUMENTS

WO WO-2022108991 A2 * 5/2022 ..... A63B 69/0048

* cited by examiner

*Primary Examiner* — Zachary T Moore
(74) *Attorney, Agent, or Firm* — John R. Ross; John R. Ross, III

(57) ABSTRACT

A physical therapy device. At least one hexagon mount section is mounted onto a backing board. The hexagon mount section includes a plurality of hexagonal cutout sections. At least one peg holder is also mounted onto the backing board. A plurality of pegs is insertable into the peg holder and also into the hexagon mount sections. A board mount is also preferably connected to the backing board. Straps, strap attachment devices and bands may by draped over the board mount.

5 Claims, 9 Drawing Sheets

PHYSICAL THERAPY DEVICE

The present invention relates to exercise and physical therapy devices, and in particular to wall mounted physical therapy devices.

BACKGROUND OF THE INVENTION

Physical therapy is a crucial part of modern exercise and rehabilitation. Proper physical therapy can greatly increase the recovery rate after an injury to the body. There are currently numerous types of devices and tools used in physical therapy offices to aid in the treatment of patients. However, many of these tools are lacking in ease of use, flexibility and efficiency. Also, many modern physical therapy aids are very expensive.

What is needed is a better, more efficient and cost-effective physical therapy device.

DETAILED DESCRIPTION OF THE PREFERRED EMBODIMENTS

The present invention provides a physical therapy device. At least one hexagon mount section is mounted onto a backing board. The hexagon mount section includes a plurality of hexagonal cutout sections. At least one peg holder is also mounted onto the backing board. A plurality of pegs is insertable into the peg holder and also into the hexagon mount sections. A board mount is also preferably connected to the backing board. Straps, strap attachment devices and bands may by draped over the board mount.

DETAILED DESCRIPTION OF THE PREFERRED EMBODIMENTS

Figure 1:
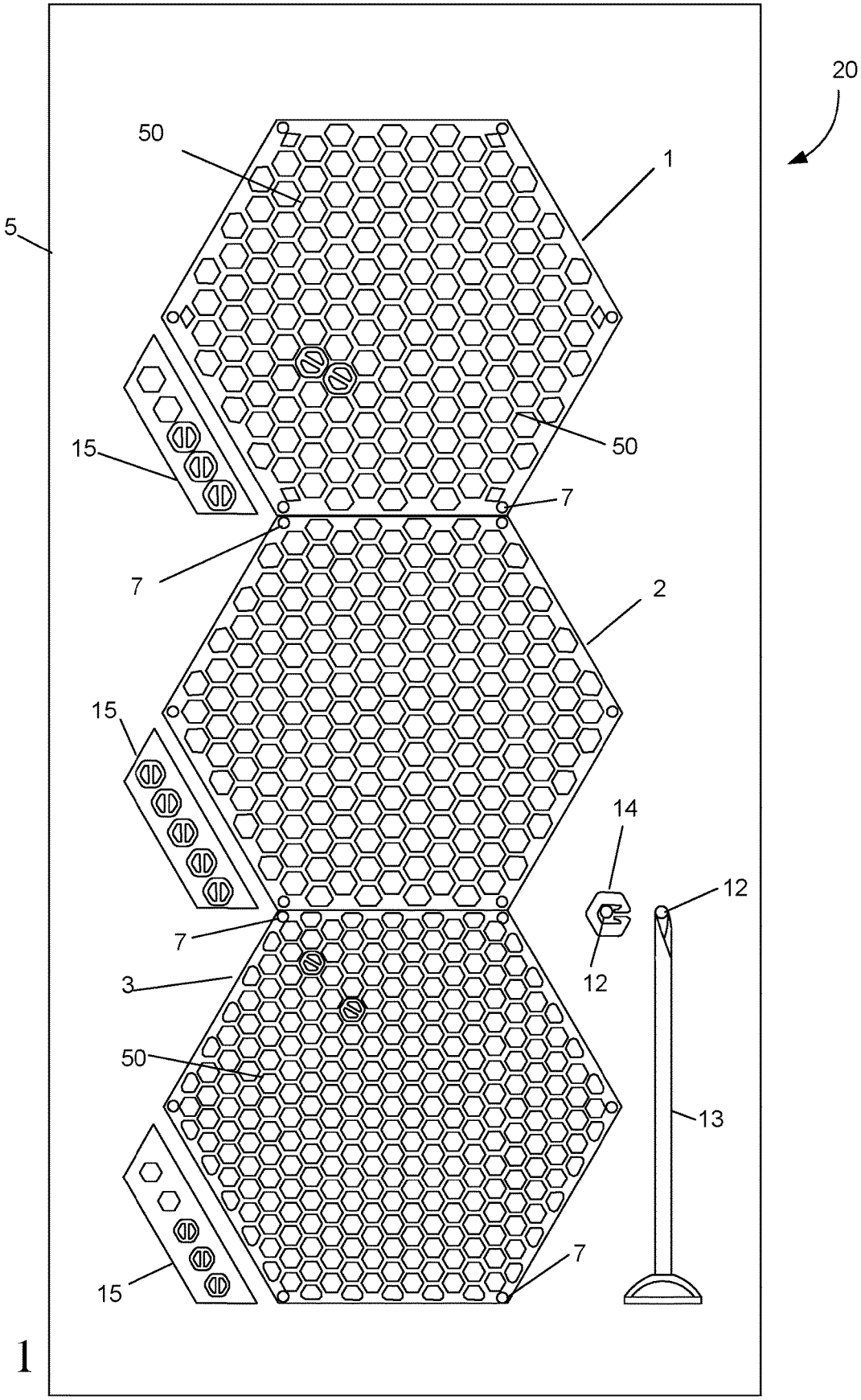
FIG. 1 shows a preferred physical therapy device.

A preferred physical therapy device 20 is shown in FIG. 1. Hexagon mount sections 1, 2 and 3 are shown arranged vertically and rigidly mounted onto backing board 5. In a preferred embodiment, hexagon mount sections 1-3 are each cut from a ½ inch thick high density polyethylene sheet. Each hexagon mount section 1-3 has a plurality of hexagonal cutout sections 50. Hexagonal pegs 10 (also preferably high-density polyethylene) are cut so that they be easily press fit into cutout sections 50. Preferably, pegs 10 are kept in backing board mounted peg holders 15 when not placed into hexagon mount sections 1-3. Board mounts 12 are rigidly attached to backing board 5. Strap 13 is shown draped over a board mount 12. Strap attachment piece 14 is shown slipped over another board mount 12.

In a preferred use, a patient will receive physical therapy by interacting with physical therapy device 20. Pegs 10 can be specifically placed onto device 20 in accordance with the patient's needs. The pegs may be placed vertically, horizontally, randomly or in a pattern. The patient may then reach for the pegs or walk his fingers up the mounted pegs, as appropriate. Also, a band or strap may be draped through hexagonal cutout sections as needed. The patient can then pull on the free end of the strap (or a handle attached to the strap) to exercise and rehabilitate.

Mounted Backing Board

In a preferred embodiment, physical therapy device 20 includes backing board 5. In the embodiment shown in FIG. 1, backing board 5 is approximately 6.5 feet×3 feet. Backing board 5 is vertically mounted onto a wall.

Hexagons

Figure 2:
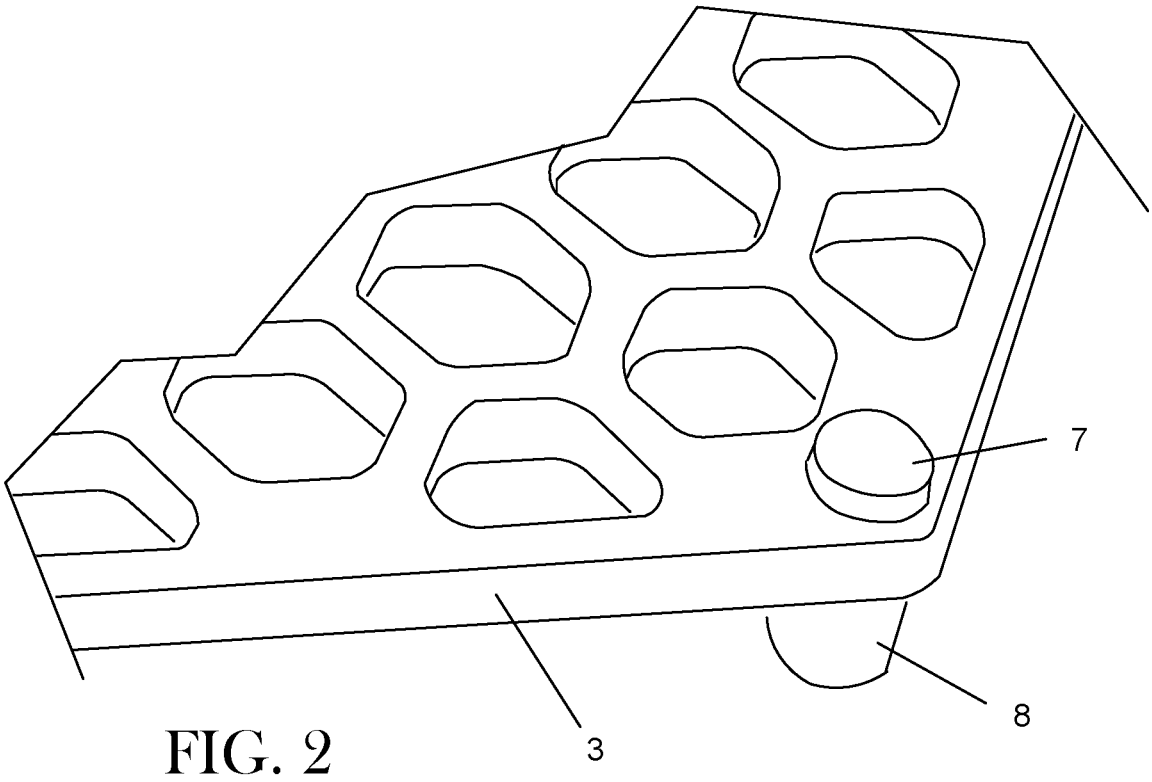
FIG. 2-3 show details of mounting a hexagon mount section.
Figure 3:
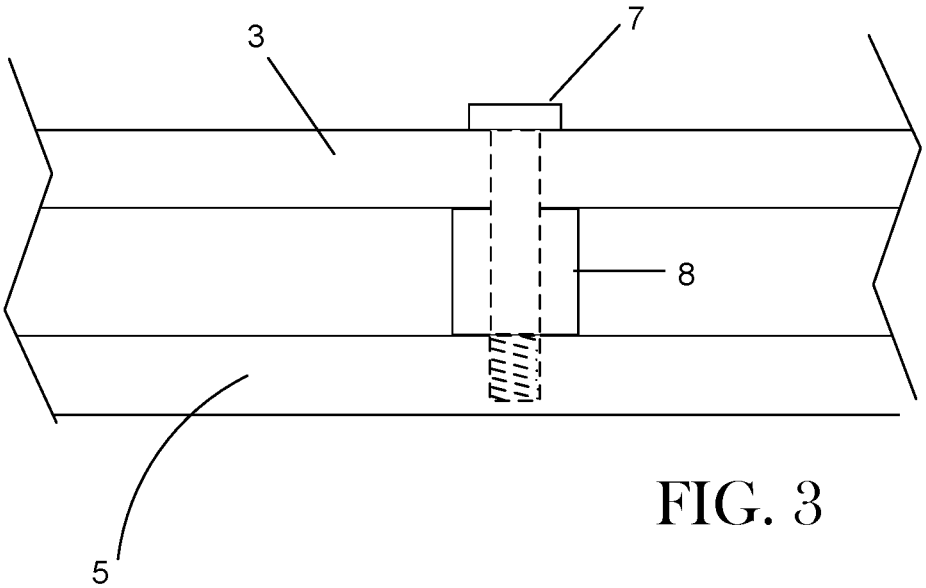

Hexagon mount sections 1-3 are mounted onto backing board 5 vertically as shown. In the embodiment shown in FIG. 1, hexagon mount sections 1-3 are approximately 2 feet in height each. Hexagon mount sections 1-3 are each mounted to backing board 5 using bolts 7 and ¾ inch spacers 8 (FIGS. 2 and 3). Spacers 8 create a space under hexagon mount sections 1-3 so that straps and bands may be easily threaded through hexagonal cutout sections 50.

It should be noted that the hexagonal cutout sections 50 of hexagon mount section 1 are larger than the hexagonal cutout sections 50 of hexagon mount section 2. Also, the hexagonal cutout sections 50 of hexagon mount section 2 are larger than the hexagonal cutout sections of hexagon mount section 3. Likewise, pegs 10 for hexagon mount section 1 are larger than the pegs for hexagon mount section 2. And pegs 10 for hexagon mount section 2 are larger than the pegs for hexagon mount section 3. The variance of size allows for the patient to more specifically customize his workout to maximize the benefit of the physical therapy.

Peg Holders

Figure 4:
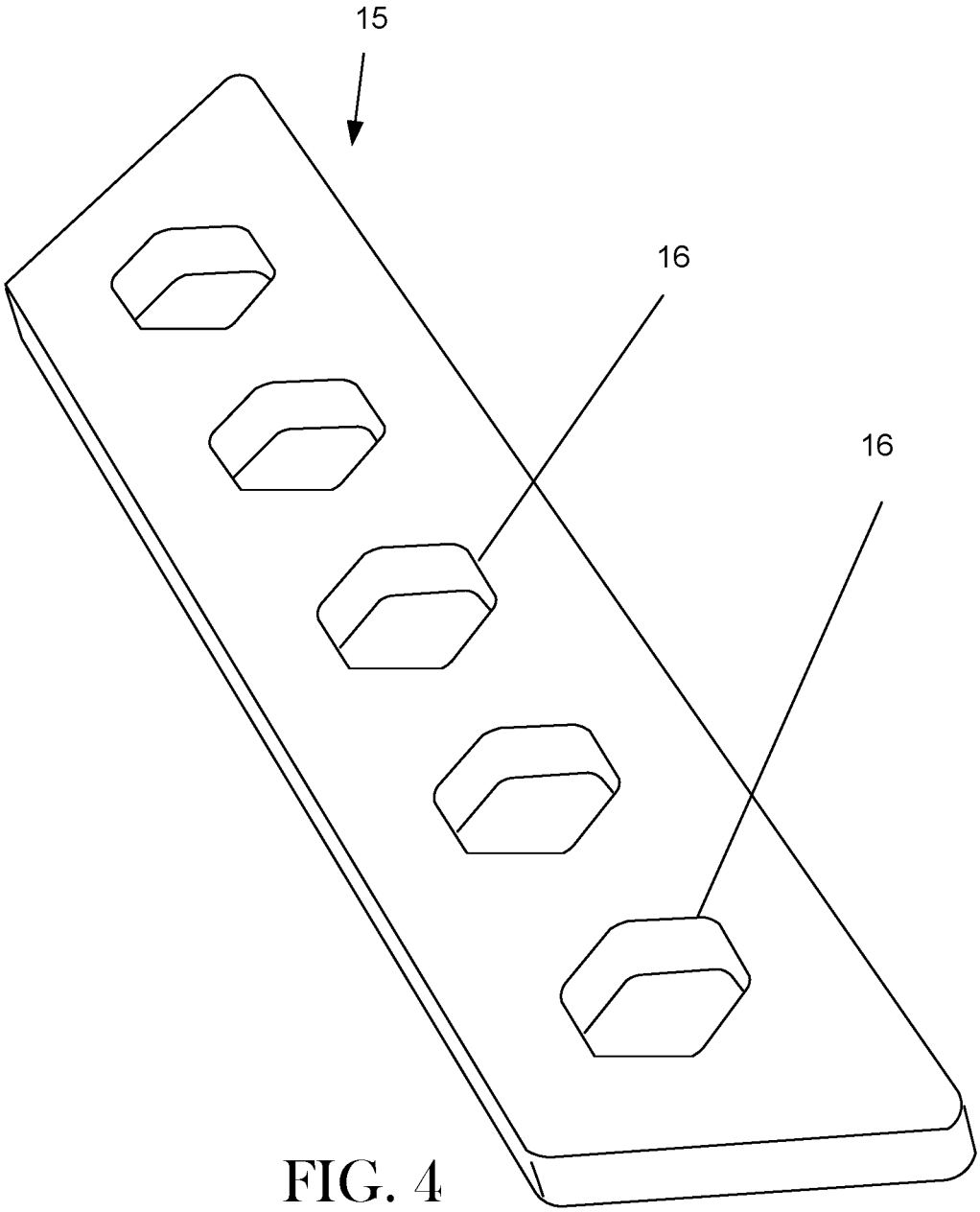
FIG. 4 shows a preferred peg holder.

FIG. 4 shows a close-up perspective view of peg holder 15. Peg holder 15 is rigidly mounted to backing board 5, as shown in FIG. 1. Pegs 10 are press-fit into peg holder 15 for storage when pegs 10 are not inserted into hexagon mount sections 1-3.

Pegs

Figure 5:
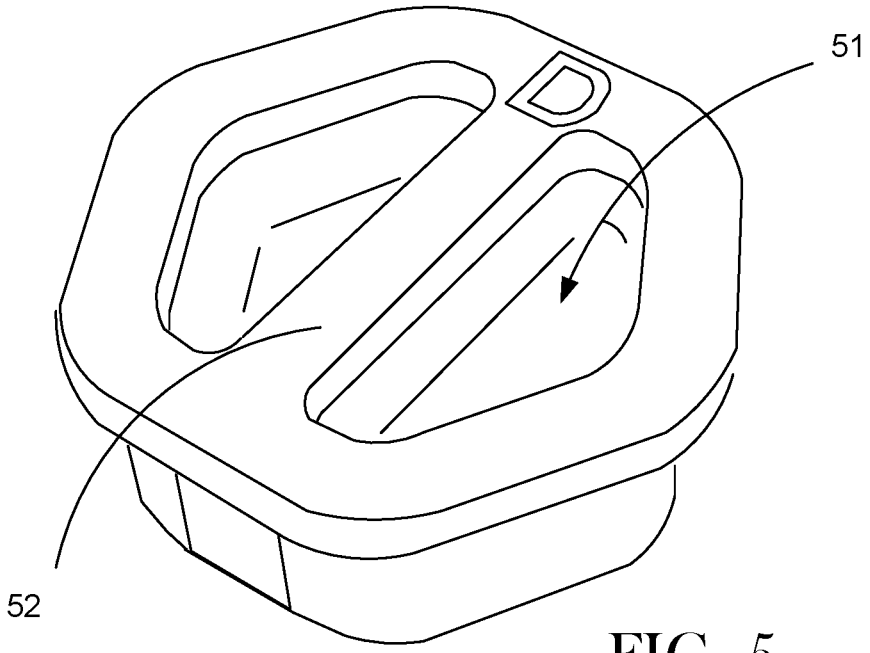
FIGS. 5-6 show preferred pegs.
Figure 6:
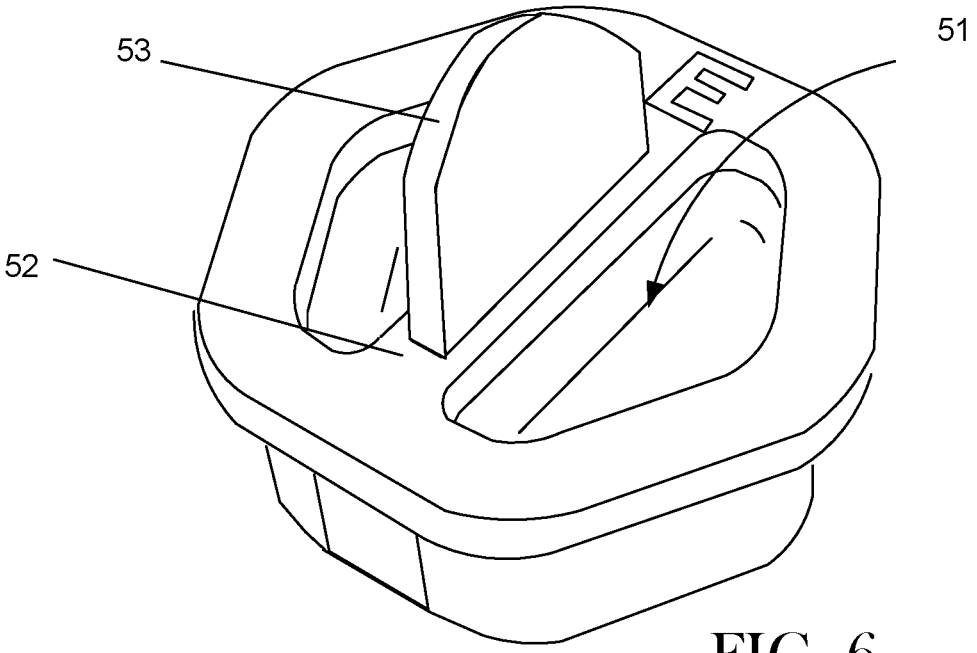

Hexagonal pegs 10 (FIG. 1) are shown in closer detail in FIGS. 5 and 6. For example, each peg is hexagonally shaped so as to be insertable and easily press-fit into cutout sections 50 on hexagon mount sections 1-3. Each peg 50 includes finger accessible cup section 51 that allows for finger access and grip section 52 that allows for the user to grab with his fingers. Also, optionally, peg 50 includes D-tab 53 that allows a user to more easily grab peg 50 or rest his fingers on peg 50 when using the peg.

Strap Attachment Pieces

Figure 7:
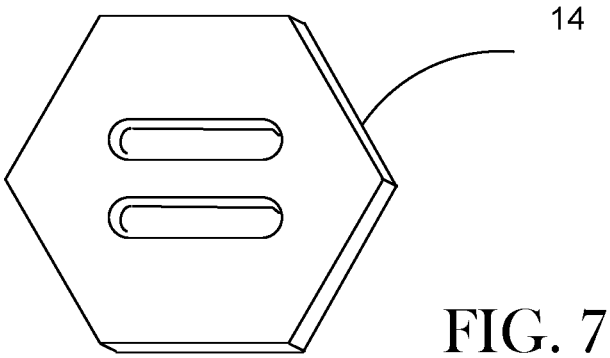
FIGS. 7-8 show preferred strap attachment devices.
Figure 8:
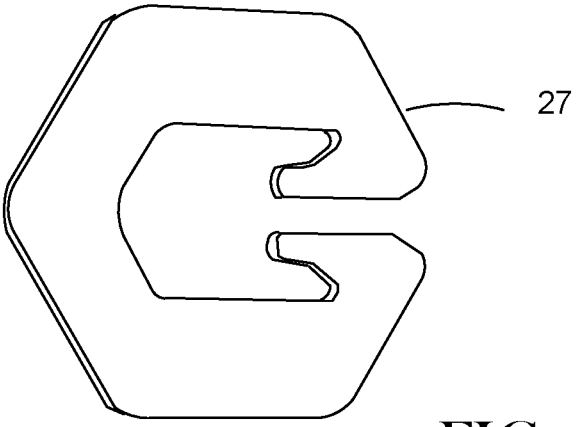

Strap attachment pieces 14 and 27 are shown in FIGS. 7 and 8. Strap attachment pieces are utilized to connect a strap (either flexible or non-flexible) to hexagon mount sections 1-3.

Utilization of the Present Invention

Figure 9:
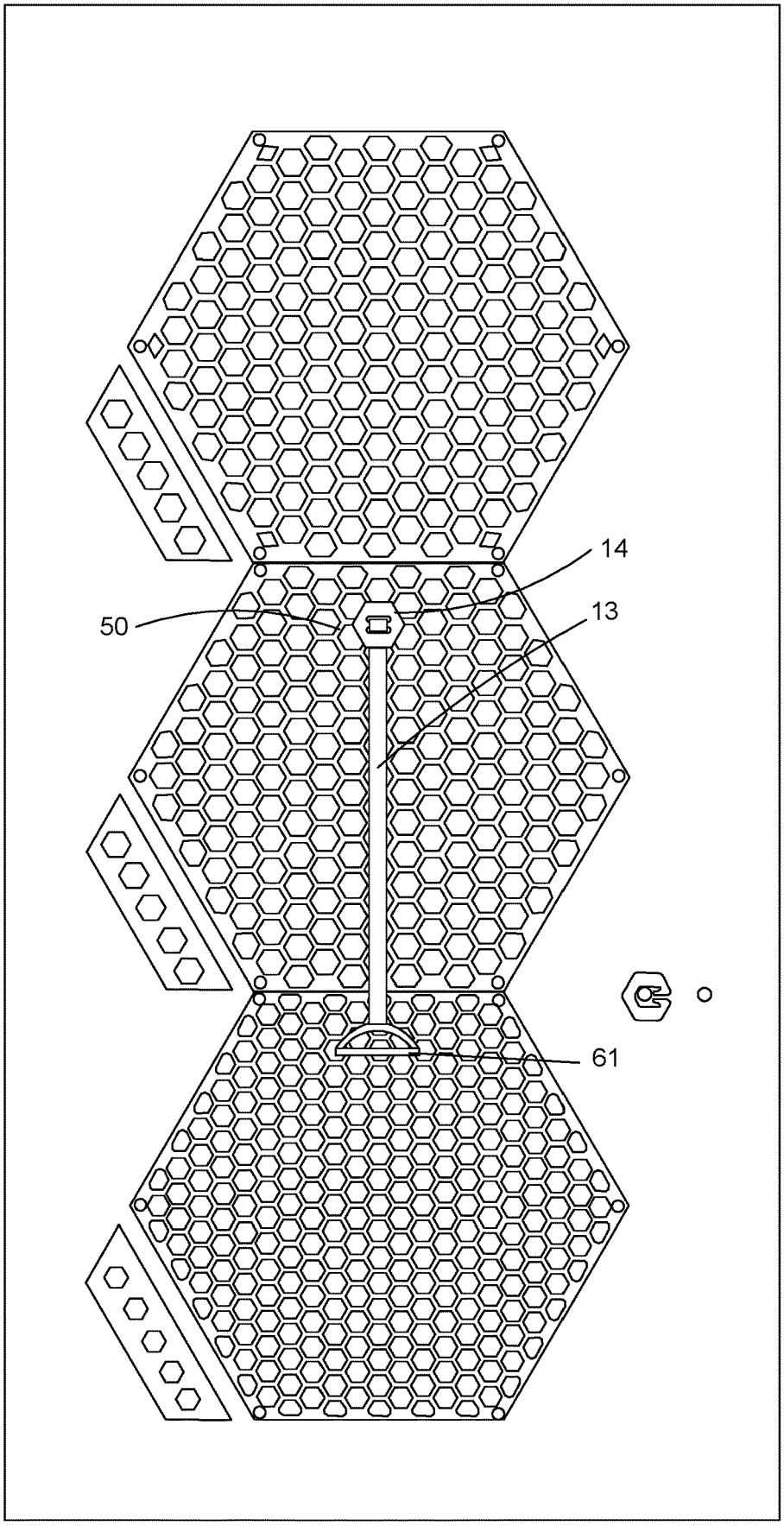
FIGS. 9-12 show preferred methods for using the physical therapy device.

FIGS. 9-12 show examples of usage of physical therapy device 20. In FIG. 9, strap 13 has been treaded through cutout sections 50 of hexagon mount section 2 and threaded through strap attachment piece 14, as shown. A patient may now grab handle 61 and exercise and rehabilitate as needed.

Figure 10:
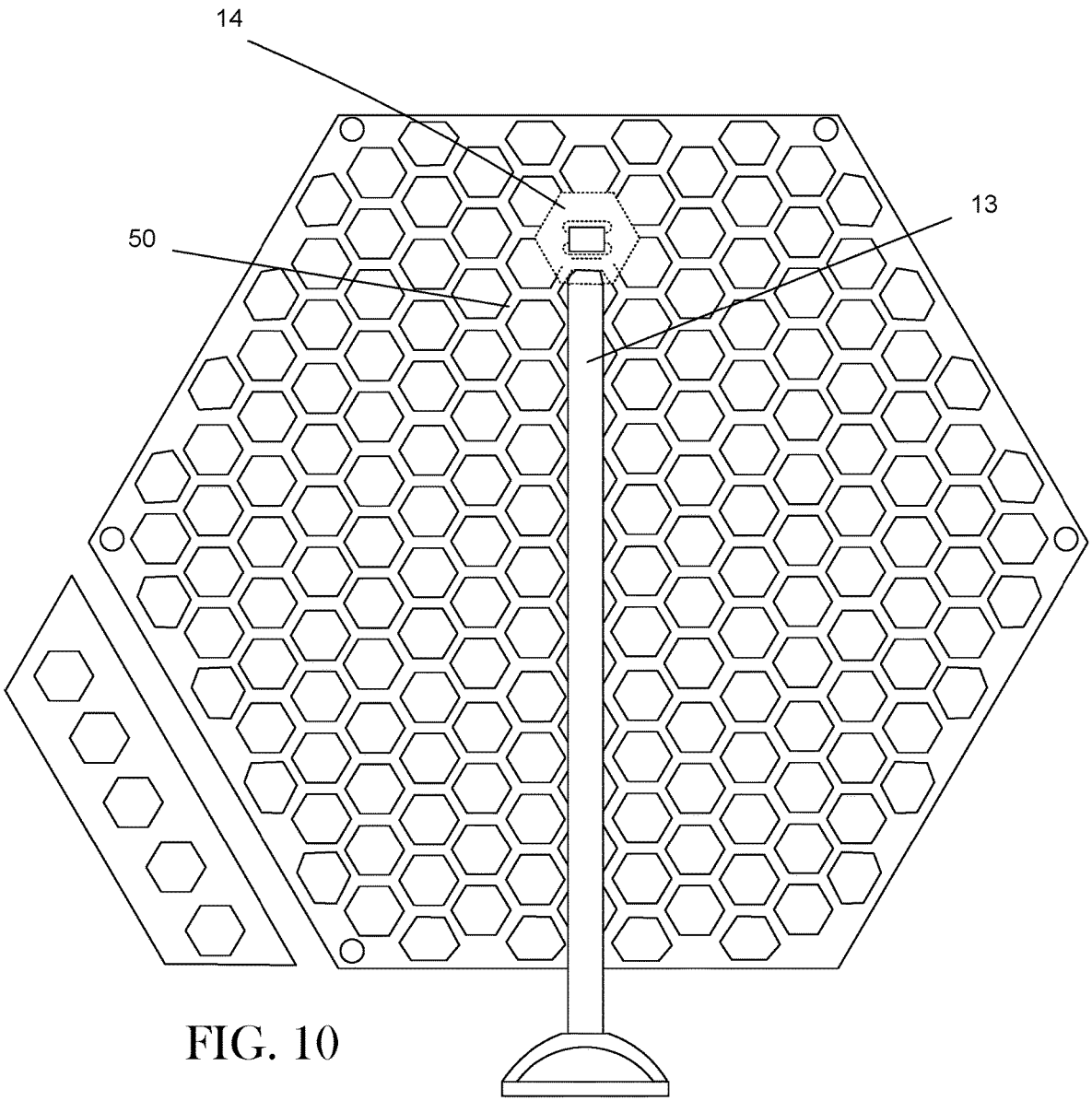

FIG. 10 shows a close-up view of strap 13 as it is threaded through cutout section 50 of hexagon 2 and strap attachment piece 14.

Figure 11:
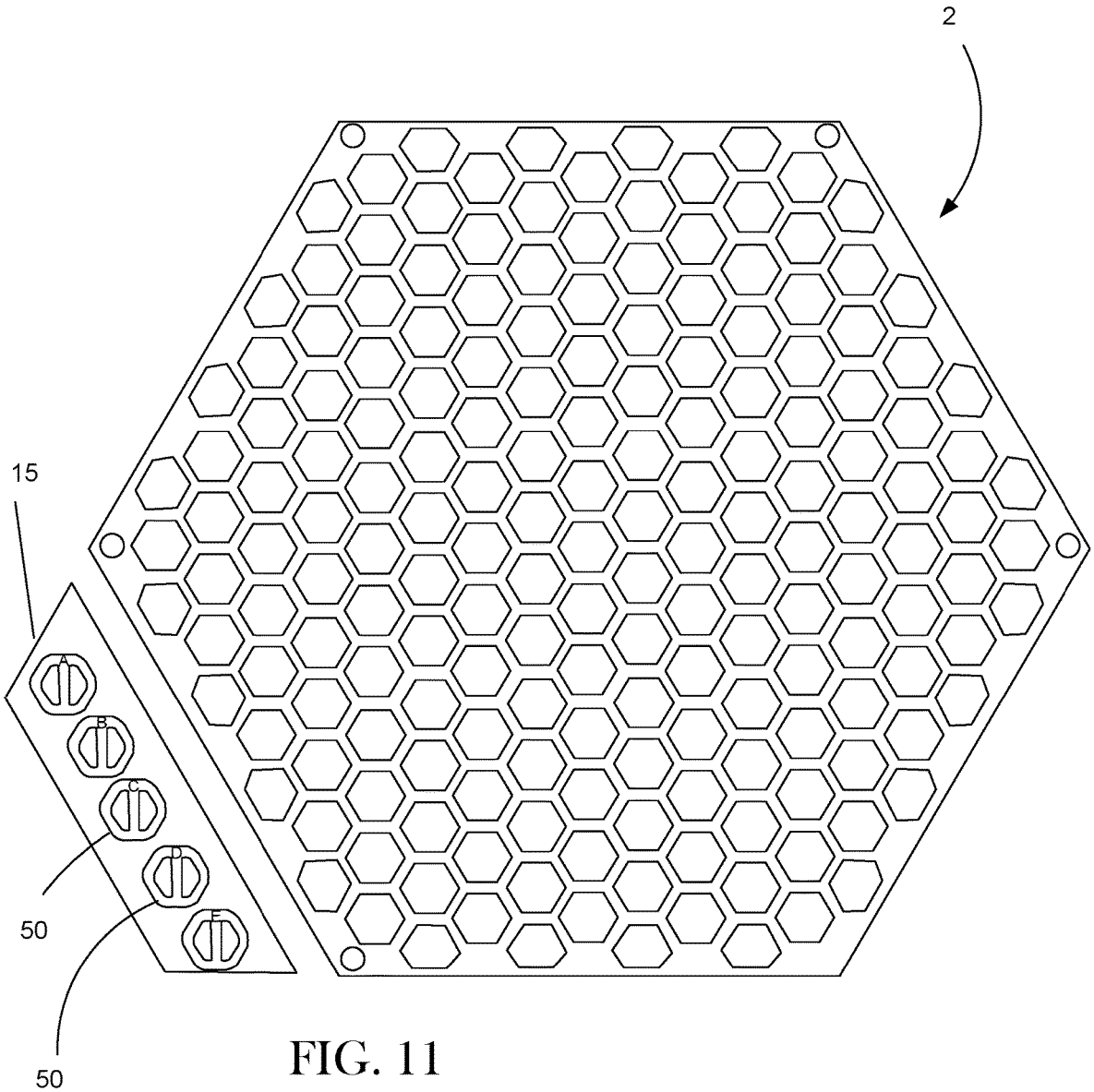

FIG. 11 shows a close-up view of hexagon mount section 2. Pegs 50 are being stored in peg holder 15. It should be noted that each peg 50 is marked as either peg A, peg B, peg C, peg D, or peg E. This will allow the patient to place the peg at an appropriate location on hexagon 2, in accordance with the physical therapy protocol.

Figure 12:
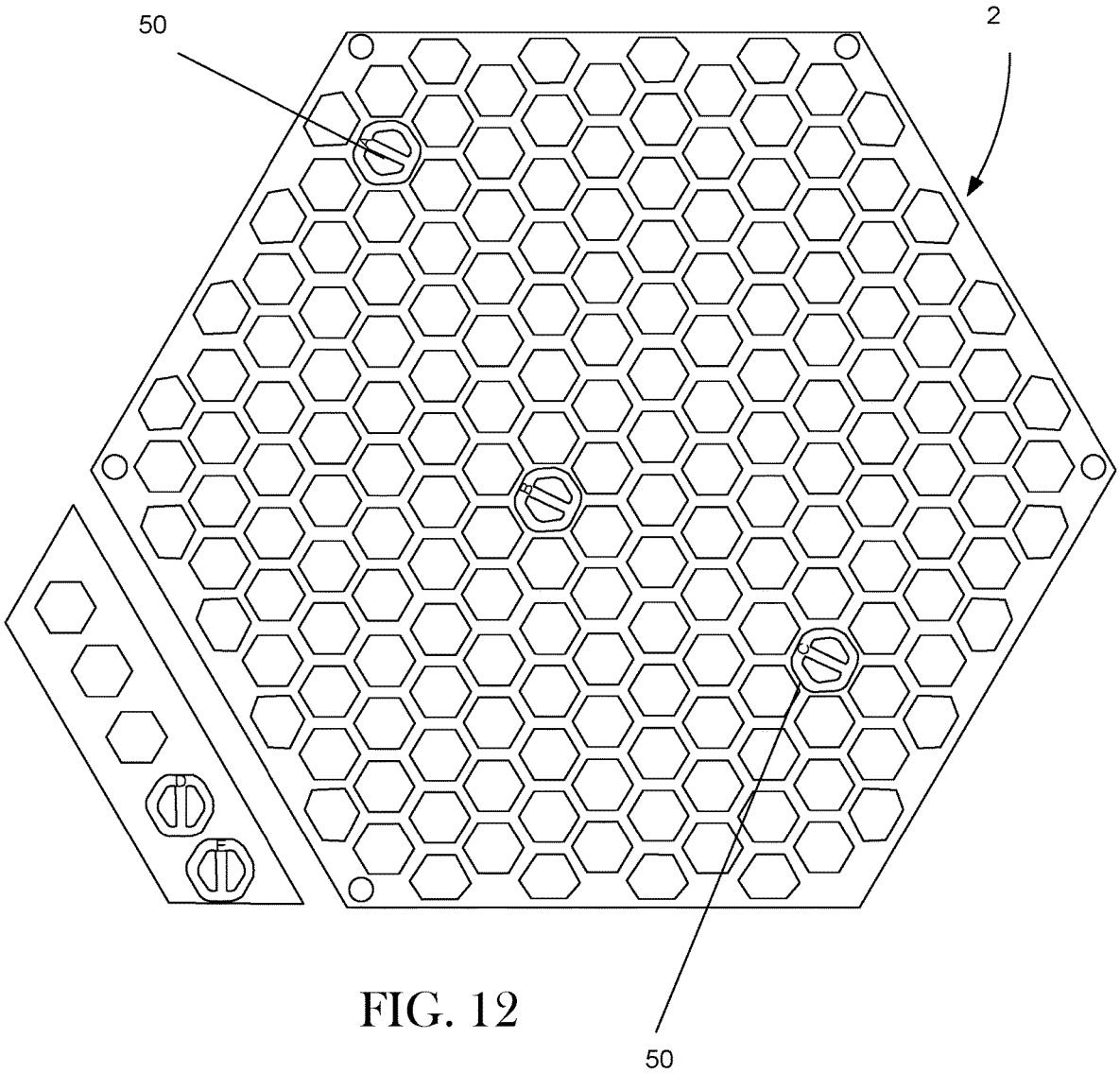

In FIG. 12, the patient has moved three of the pegs 50 (peg A, peg B and peg C) onto hexagon mount section 2. The patient may now engage in physical therapy.

Although the above-preferred embodiments have been described with specificity, persons skilled in this art will recognize that many changes to the specific embodiments disclosed above could be made without departing from the spirit of the invention. For example, Applicant has recognized that the hexagon is a very strong and efficient shape and is therefore preferred. As noted, the above embodiments specifically discussed hexagon mount sections and hexagonal pegs. However, it would also be possible to construct a similar physical therapy device using other geometric shapes, such as squares, rectangles, triangles or heptagons. Therefore, the attached claims and their legal equivalents should determine the scope of the invention.

What is claimed is:

1. A physical therapy device, comprising:

a backing board, at least one hexagon mount section mounted onto said backing board, said at least one hexagon mount section comprising a plurality of hexagonal cutout sections, at least one peg holder rigidly mounted onto said backing board, at least one peg for selective insertion into said hexagonal cutout sections and said at least one peg holder, at least one board mount, and at least one strap and a strap attachment piece, wherein said at least one strap is threaded through said at least one hexagonal cutout section and said at least one strap attachment piece.

2. The physical therapy device of claim 1, wherein said backing board is vertically mounted to a wall.

3. The physical therapy device of claim 1, further comprising a plurality of spacers for spacing said at least one hexagon mount section away from said backing board.

4. The physical therapy device of claim 1 wherein said at least one hexagon mount section is three hexagon mount sections.

5. The physical therapy device of claim 1, wherein said at least one peg comprises:

a cup section, a grip section, and a D-tab.

* * * * *